US005968613A

United States Patent [19]

Lin

[11] Patent Number: 5,968,613

[45] Date of Patent: Oct. 19, 1999

[54] LAMP NETTING ASSEMBLY

[76] Inventor: Mei-Lu Lin, 56, Min Sheng Street, Fengyuan, Taichung, Taiwan

[21] Appl. No.: 08/887,990

[22] Filed: Jul. 3, 1997

[51] Int. Cl.[6] ..... F21V 33/00

[52] U.S. Cl. ..... 428/9; 428/7; 362/252; 362/806

[58] Field of Search ..... 428/7, 9; 362/252, 362/806, 808

*Primary Examiner*—Alexander Thomas

[57] ABSTRACT

A lamp netting assembly has a net, a serial decoration lamp assembly disposed on the net, the serial decoration lamp assembly having a plurality of decoration lamps and a wire, a plurality of retainer plates retaining the respective decoration lamps on the net, and two opposite rods disposed on two laterals of the net. The lamp netting assembly is disposed on a panel. The net has a plurality of net threads forming a plurality of meshes. A pattern string is marked or knit on the net. The retainer plates are arranged in series along the pattern string.

4 Claims, 6 Drawing Sheets

LAMP NETTING ASSEMBLY

BACKGROUND OF THE INVENTION

This invention relates to a lamp netting assembly, and more particularly, this invention relates to a lamp netting assembly which contains a plurality of decoration lamps.

Referring to FIGS. 1 and 1A, a conventional frame device 10 for a Christmas tree has a plurality of positioning clamps 11 to clamp a serial decoration lamp assembly (not shown in the figures). However, the conventional frame device 10 occupies a large room.

SUMMARY OF THE INVENTION

An object of this invention is to provide a lamp netting assembly in order to position a serial decoration lamp assembly on a net stably.

Another object of this invention is to provide a lamp netting assembly which can be disassembled and assembled again to form various patterns.

Another object of this invention is to provide a lamp netting assembly to position a serial decoration lamp assembly on a foldable net so that the decoration lamp netting will not fall down under a strong wind while the decoration lamp netting is placed outdoors.

DETAILED DESCRIPTION OF THE INVENTION

Figures 1, 1A:
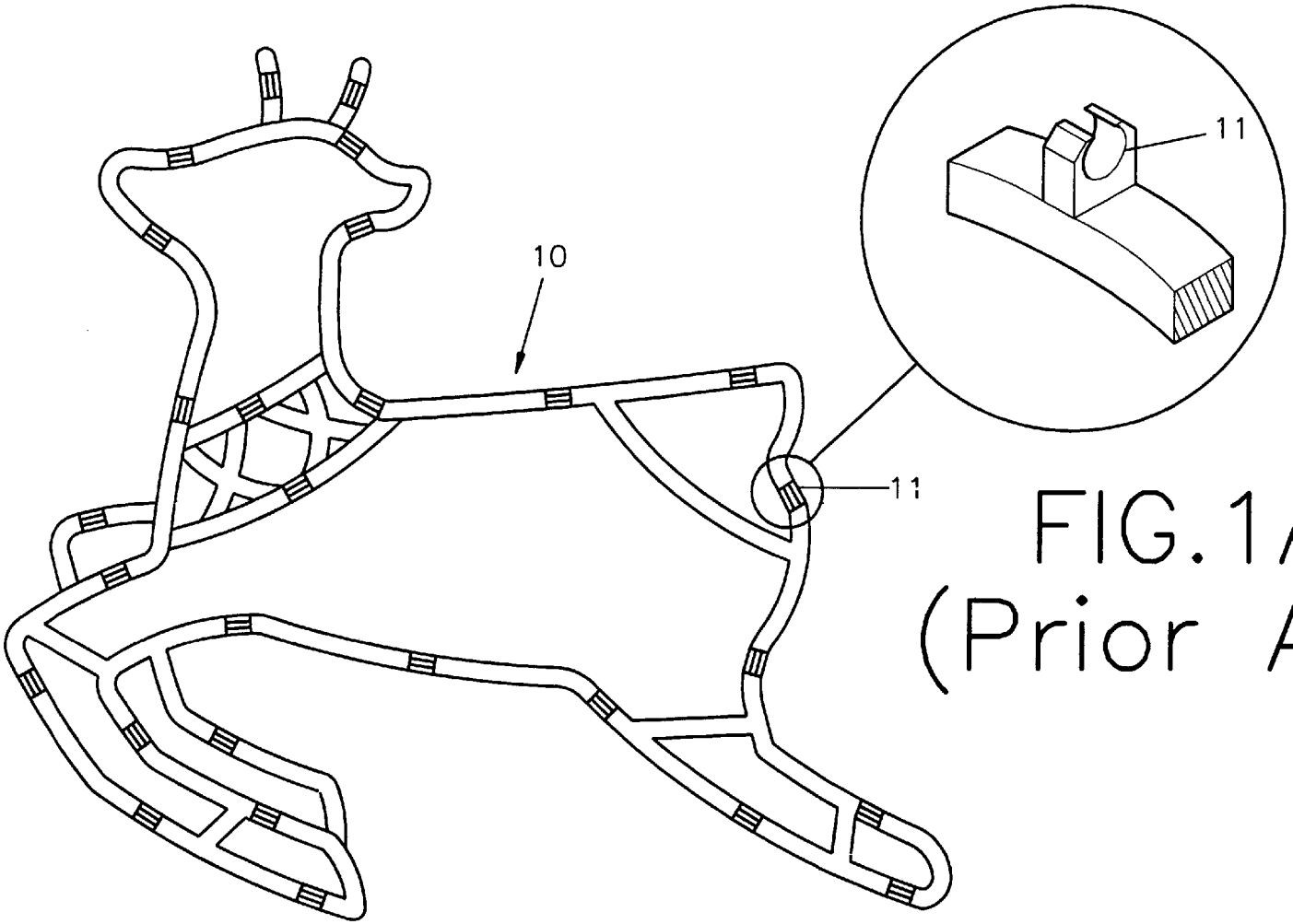
FIG. 1A (Prior Art)
FIG. 1 (Prior Art)
FIG. 1 is a schematic view of a conventional frame device of the prior art.
FIG. 1A is a perspective view of a positioning clamp.
Figure 2:
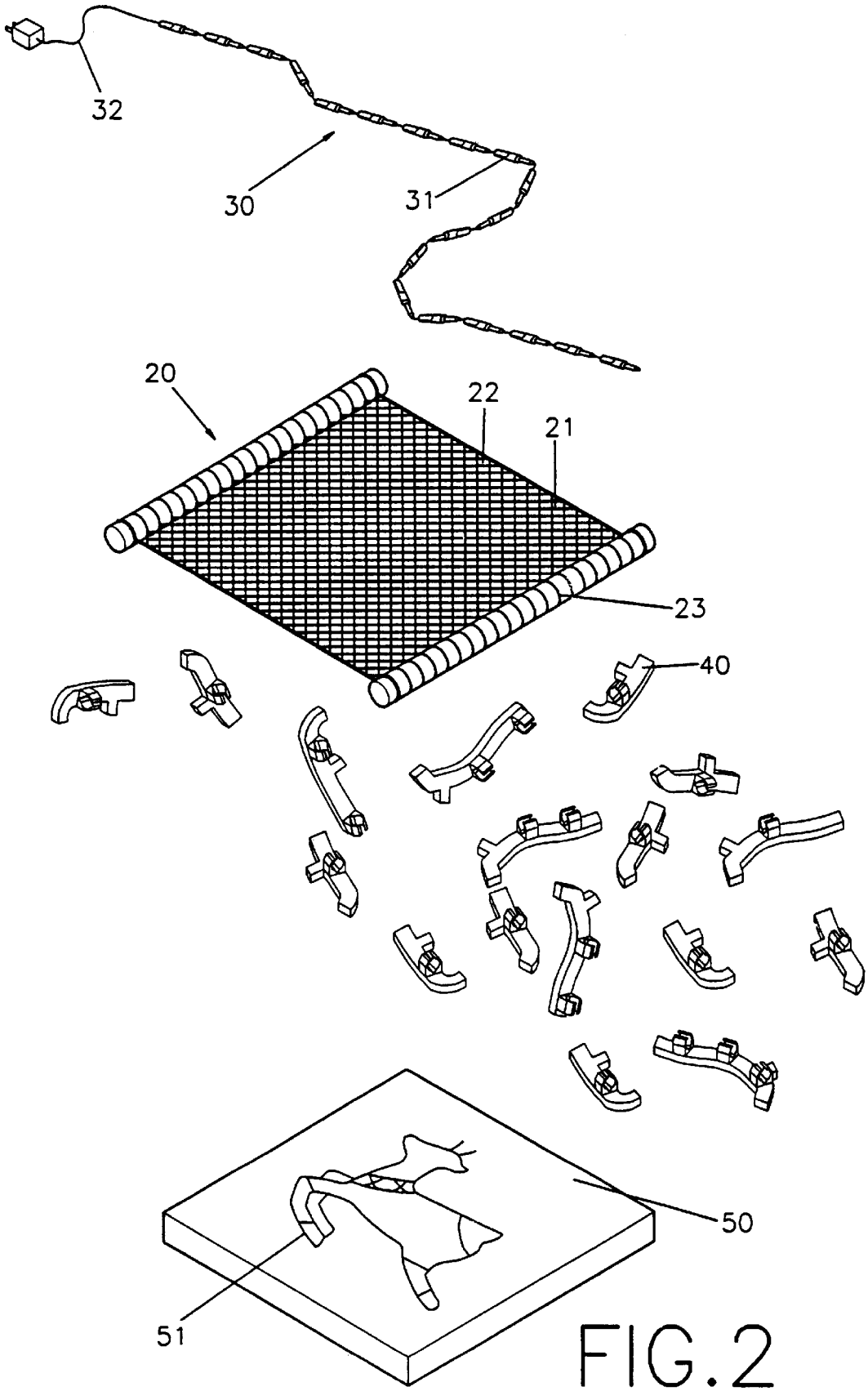
FIG. 2 is a perspective exploded view of a lamp netting assembly and a panel.
Figure 2A:
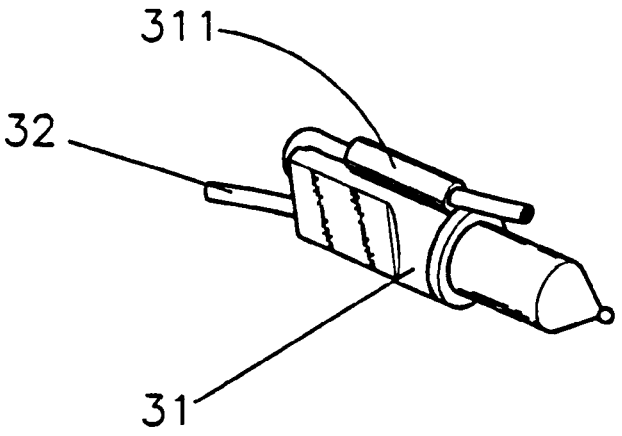
FIG. 2A is a perspective view of a decoration lamp.
Figure 2B:
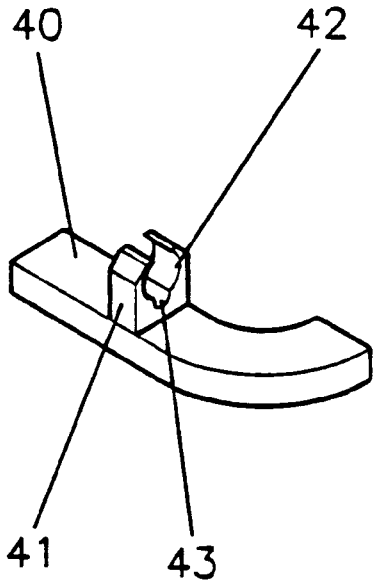
FIG. 2B is a perspective view of retainer plate.
Figure 3A:
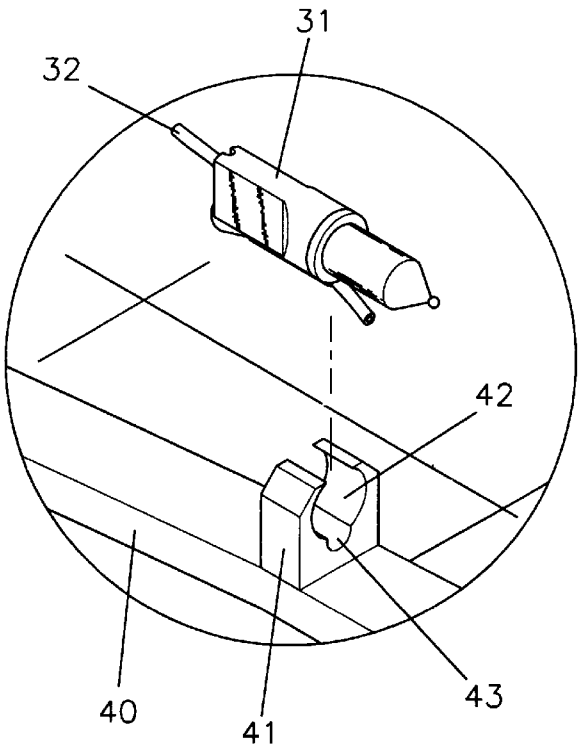
FIG. 3A is a perspective exploded view of a retainer plate and a decoration lamp.
Figure 3:
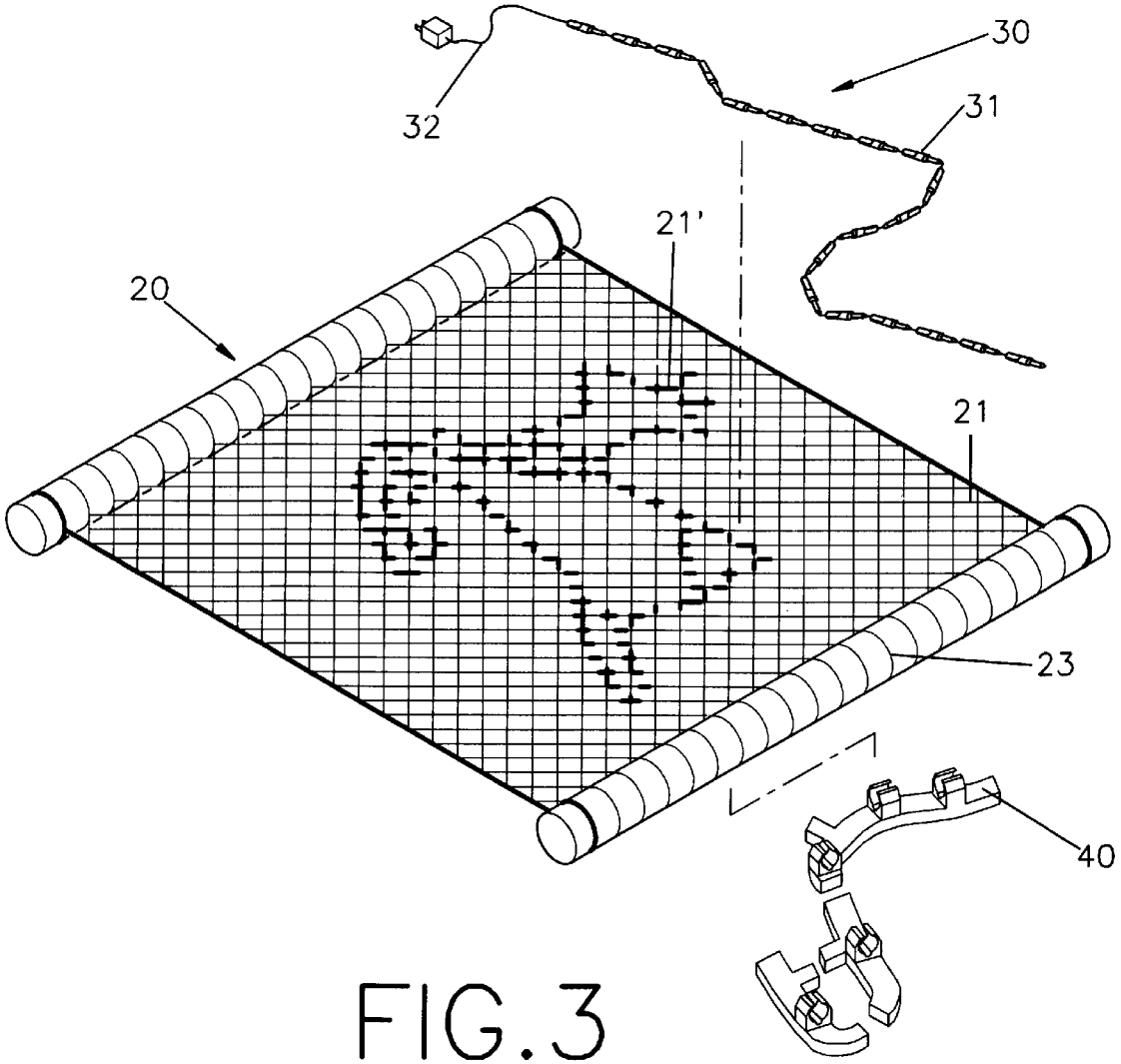
FIG. 3 is a perspective exploded view of a lamp netting assembly without a panel.
Figure 4:
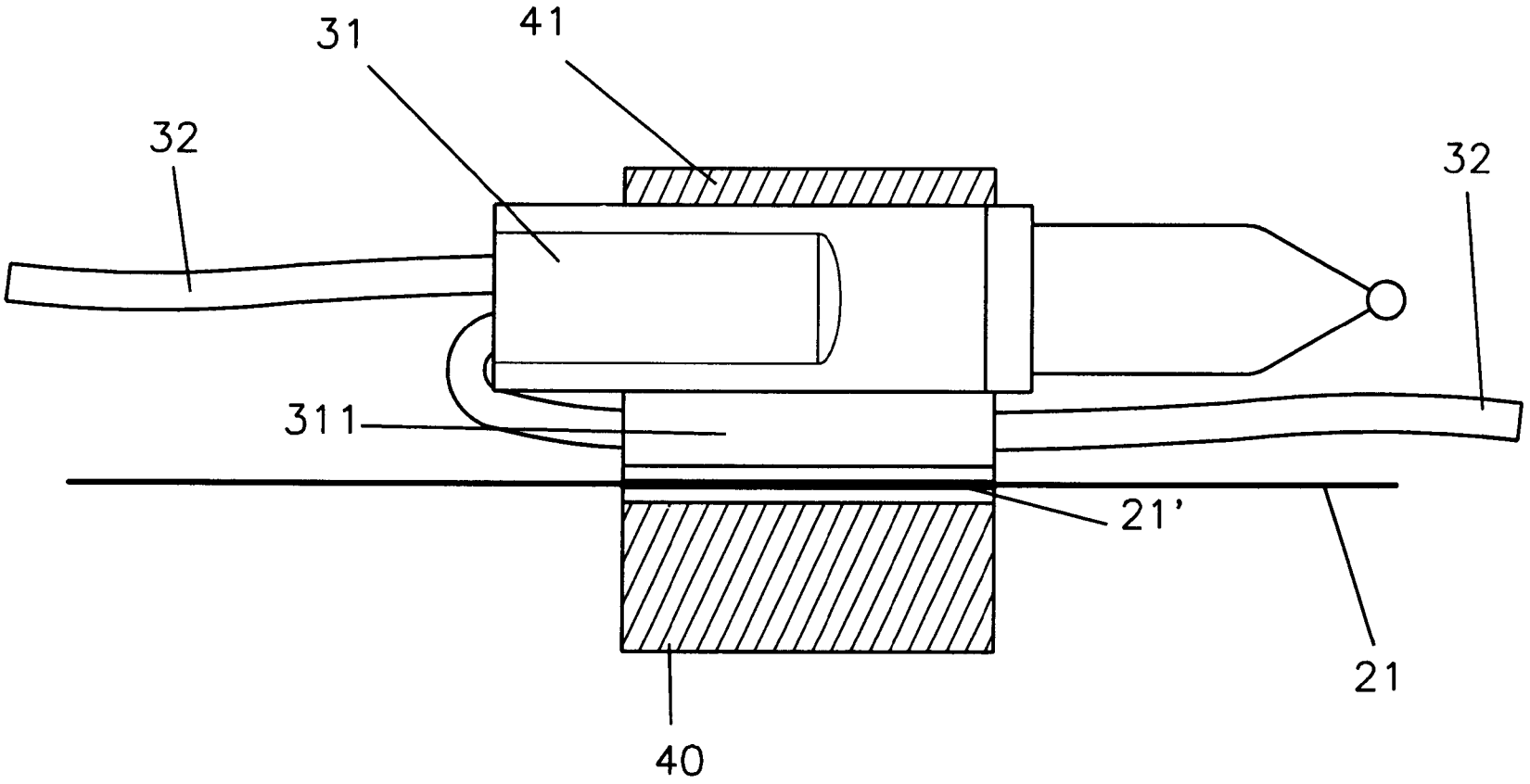
FIG. 4 is a sectional schematic view illustrating a retainer plate clamping a decoration lamp.
Figure 5A:
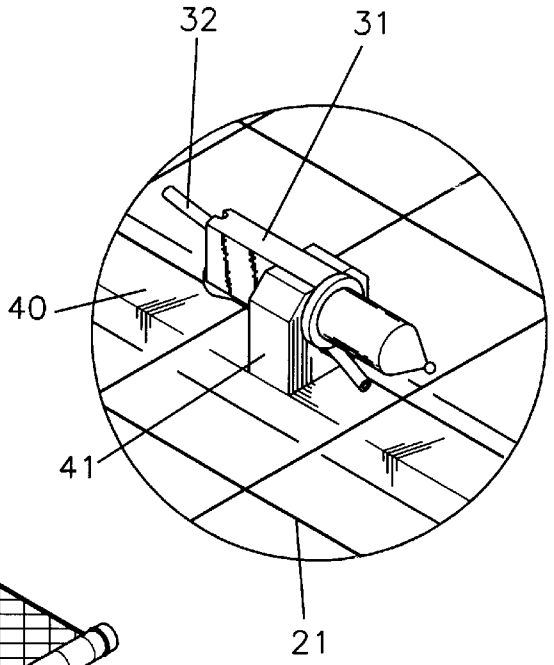
FIG. 5A is a perspective view illustrating a retainer plate clamping a decoration lamp.
Figure 5:
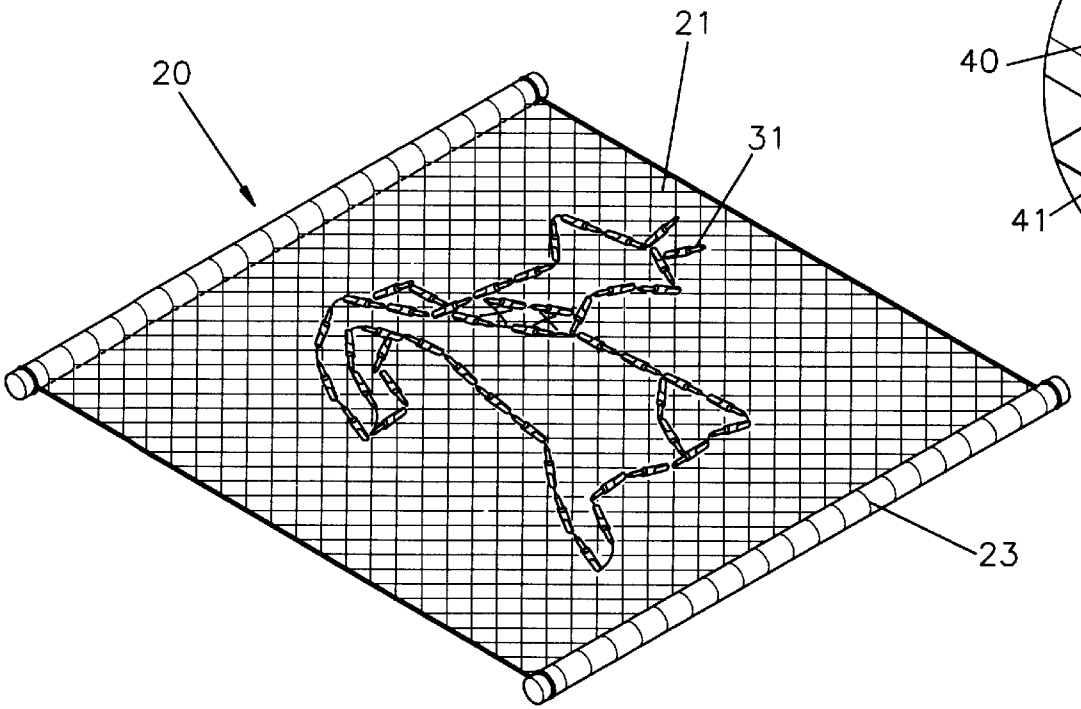
FIG. 5 is a perspective view of FIG. 3.

Referring to FIGS. 2 to 5A, a lamp netting assembly comprises a net 20, a serial decoration lamp assembly 30 disposed on the net 20, the serial decoration lamp assembly 30 having a plurality of decoration lamps 31 and a wire 32, a plurality of retainer plates 40 retaining the respective decoration lamps 31 on the net 20, and two opposite rods 23 disposed on two laterals of the net 20. The lamp netting assembly is disposed on a panel 50.

The net 20 has a plurality of net threads 21 forming a plurality of meshes 22.

The panel 50 has at least a pattern groove 51. The net 20 is extended on the panel 50. The serial decoration lamp assembly 30 is disposed on the net 20 and arranged along the pattern groove 51. Each of the retainer plates 40 retains the respective decoration lamp 31 on the net 20. The rods 23 support the lamp netting assembly.

Each of the retainer plates 40 has a clamp device 41, a slot 42 formed in the clamp device 41 to receive the respective decoration lamp 31, and a recess 43 formed in the clamp device 41 to communicate with the slot 42. The retainer plates 40 are arranged along the pattern groove 51 in series.

At least a pattern string 21' is marked or knit on the net 20 according to the shape of the pattern groove 51. The user can arrange the retainer plates 40 in series along the pattern string 21'. Therefore, the user need not use the pattern groove 51.

It is an option to provide a plurality of pattern strings to mark various patterns.

It is an option to provide a pattern fabric knitted on the net 20 instead of the pattern string 21'. The pattern fabric comprises a plurality of holes.

Therefore, the lamp netting assembly can position the serial decoration lamp assembly 30 on a net 20.

I claim:

1. A lamp netting assembly comprises:

a net, a serial decoration lamp assembly disposed on the net, the serial decoration lamp assembly having a plurality of decoration lamps and a wire, a plurality of retainer plates retaining the respective decoration lamps on the net, two opposite rods disposed on two laterals of the net, at least a pattern string marked on the net, and each of the retainer plates having a clamp device, a slot formed in the clamp device to receive the respective decoration lamp, and a recess formed in the clamp device to communicate with the slot.

2. A lamp netting assembly as claimed in claim 1, wherein the lamp netting assembly further comprises a plurality of pattern strings.

3. A lamp netting assembly as claimed in claim 1, wherein the lamp netting assembly further comprises a pattern fabric.

4. A lamp netting assembly as claimed in claim 3, wherein the pattern fabric comprises a plurality of holes.

* * * * *